US005387733A

United States Patent [19]

Weaver

[11] Patent Number: 5,387,733

[45] Date of Patent: Feb. 7, 1995

[54] METHOD FOR THE INHIBITION AND REMOVAL OF AMMONIUM CHLORIDE DEPOSITION IN HYDROCARBON PROCESSING UNITS

[75] Inventor: Carl E. Weaver, Conroe, Tex.

[73] Assignee: Betz Laboratories, Inc., Trevose, Pa.

[21] Appl. No.: 74,239

[22] Filed: Jun. 9, 1993

[51] Int. Cl.[6] ..... C07C 7/20; C09K 3/00

[52] U.S. Cl. ..... 585/899; 208/47; 252/394

[58] Field of Search ..... 208/47; 585/899; 252/394

[56] References Cited

U.S. PATENT DOCUMENTS 3,819,328 6/1974 Go ..... 21/2.5 R
3,932,296 1/1976 Byth ..... 252/148
4,793,865 12/1988 Staley et al. ..... 134/2
4,855,035 8/1989 Schutt ..... 208/47
4,877,578 10/1989 Zetlmeisl et al. ..... 422/14
4,927,561 5/1990 Forester ..... 252/389.22

*Primary Examiner*—Anthony McFarlane
*Assistant Examiner*—Nhat D. Phan
*Attorney, Agent, or Firm*—Alexander D. Ricci; Gregory M. Hill

[57] ABSTRACT

A method for the inhibition and removal of ammonium chloride deposits on the internal surfaces of the equipment in a refinery which processes liquid hydrocarbon at elevated temperatures consisting of adding to the liquid hydrocarbon a non-filming polyamine. The amount of non-filming polyamine added to the system is based upon the amount of ammonium chloride present in the system and is preferably in the range of about 1 to 10 moles per mole of ammonium chloride.

12 Claims, No Drawings

METHOD FOR THE INHIBITION AND REMOVAL OF AMMONIUM CHLORIDE DEPOSITION IN HYDROCARBON PROCESSING UNITS

FIELD OF THE INVENTION

The present invention relates to the field of hydrocarbon processing and specifically deals with the problems associated with the deposition of ammonium chloride salt crystals on metallic surfaces of the overhead equipment in elevated temperature processing units.

BACKGROUND OF THE INVENTION

A frequent source of operating problems in refining and hydrocarbon processing units is the formation of deposits on the internal metallic surfaces throughout those units resulting in an increase in pressure drop, decrease in efficiency, increase in energy consumption, loss of operating time, and other well-known difficulties. These deposits include salts of ammonia, inorganic contaminants that enter the process in the feed, and deposits that develop as by-products. From corrosion of the processing unit including metal sulfides, metal oxides, metal hydroxides, and other metal salts. These deposits alone or in combination with other hydrocarbon polymers and decomposition products often form deposits that are difficult to remove from the internals of the processing units.

During the processing of hydrocarbon liquids, such as crude oil, at elevated temperatures such as between 200° and 500° F. in a refinery, small amounts of water emulsified or otherwise entrained in the hydrocarbon will first vaporize and then later condense on the metallic surfaces of the overhead equipment of the high temperature units, such as distillation columns. This water contains acidic elements, predominantly hydrochloric acid (HCl), which will corrode the surfaces of the overhead equipment at locations where condensation occurs.

In an attempt to minimize this corrosion, hydrocarbon processors will add chemical compounds to the hydrocarbon prior to elevated temperature processing for the purpose of neutralizing the acid, e.g., HCl. The compound most frequently employed is ammonia. The ammonia will neutralize the HCl by forming ammonium chloride.

The neutralization of HCl by ammonia mitigates against the problems of corrosion. However, the formation of ammonium chloride causes others. The ammonium chloride, which is vaporized during elevated temperature processing, is sublimed onto the internal surfaces of the overhead equipment. Sublimation, as herein defined, is intended to mean that the ammonium chloride passes directly from the vapor state to its solid crystaline form, bypassing its liquid phase. Crystaline ammonium chloride builds up on these surfaces resulting in the operational problems previously discussed.

U.S. Pat. No. 4,703,865 (Staley, et al.,) describes a method where low melting point/oxygenated liquid amines are injected in hydrocarbon processing units to remove and/or to prevent the formation of ammonium salt deposits. Furthermore, oxygen containing hydrocarbon compounds are injected in hydrocarbon processing units to remove metal compound deposits. The oxygenated amines and/or the oxygen containing compounds may be injected alone or in combination. In addition, these amines and/or the oxygen containing compounds are used in combination with filming agents which causes corrosion in such units.

U.S. Pat. No. 4,877,578 (Zetlmeisl et al.) discloses the use of the reaction product of an alkylenepolyamine and formaldehyde in a water system containing ammonium chloride, in the hydrocarbon overhead systems of a refinery, for the purpose of inhibiting corrosion. They disclose that the polyamides alone are less effective than the reaction product (col 6, lines 59–62). However, they do not mention the problem of ammonium chloride deposition, by sublimation of the ammonium chloride to the cool parts of the overhead system, and do not teach the use of the polyamines for the purpose of inhibiting such ammonium chloride deposits.

U.S. Pat. No. 4,855,053, Schutt, discloses that ammonium bisulfate deposition may be abated by adding large amounts of ammonium chloride.

It is an object of the present invention to inhibit the growth and/or facilitate the removal of ammonium chloride deposits on the surfaces of the overhead equipment in a hydro-carbon refinery. The aforementioned problems are overcome by the present invention which discloses a method for the complete removal and/or prevention of the formation of deposits of ammonium chloride.

DETAILED DESCRIPTION OF THE INVENTION

The method of the present invention comprises adding to a hydrocarbon liquid prior to elevated temperature processing (i.e. 200° -500° F.) an amount of a non-filming polyamine effective for the purpose of inhibiting the formation or providing for the removal of ammonium chloride deposits.

The non-filming polyamines which exhibit unexpected utility according to the process of the present invention have the following structure:

$R_2N—[(CHR')_xNH]_y—H$ where $R=H$ or $C_1$–$C_6$ alkyl or $—[(CHR')_xNH]_y—H$ $R'=H$ or $C_1$–$C_6$ alkyl or $—[(CHR')_xNH]_y—H$ $x=2,3$ $y=1$–$6$ Examples of such products are dimethylaminopropylamine (DMAPA), diethylenetriamine(DETA), ethylenediamine(EDA), and tris-(2-aminoethyl) amine, (TREN).

The non-filming polyamine of the present invention is utilized at a petroleum refinery experiencing ammonium chloride deposition problems due to the addition of ammonia used to control HCl. It may be added to the hydrocarbon liquid at any convenient location prior to the location or locations where elevated temperature processing of the hydrocarbon occurs and sublimation of ammonium chloride subsequently results. Suitable locations are within the crude unit distillation tower, into the trays within these towers, heat exchangers, receiving tanks, pump-rounds, overhead lines, reflux lines, connecting lines and the like.

The amount of the non-filming polyamine required to achieve the desired objective of inhibiting or removing ammonium chloride deposition will vary and will depend upon the amount of ammonium chloride present in the hydrocarbon liquid prior to elevated temperature processing. The preferred method of determining the correct amount of non-filming polyamine that must be added is by measuring the amount of ammonium chloride present in the hydrocarbon liquid. This may be accomplished by one of many well known means of analysis such as the phenate method for the determination of nitrogen, #417C from the Standard Methods for the Examination of Water and Wastewater, 16th Ed., pp 382–383, incorporated herein by reference. Thereafter, the moles of ammonium chloride present are determined by conventional calculation methods.

The amount of non-filming polyamine necessary to achieve the objectives of the invention is a factor of the moles of ammonium chloride present in the hydrocarbon. This amount may be in the range of 1–10,000 ppm, by weight, based on the hydrocarbon liquid. Depending on the distinct design characteristics or operating conditions of the hydrocarbon processing unit to be treated, the amount to be added falls within the range of 1 to 10 moles of non-filming polyamine per mole of ammonium chloride.

The non-filming polyamine may be added to the hydrocarbon liquid either continuously or intermittently, as the processing unit design or operating conditions dictate. The compound may be added neat, or it may be dissolved as necessary in a suitable solvent.

EXAMPLES

A conventional laboratory reflux apparatus was employed to establish the efficacy of the present invention. It is well known that salt deposits will form equally as well on the internal surfaces of a glass reflux device as on the internal metal surfaces of the overhead equipment of a refinery. The test consisted of heating to reflux for 4 hours 0.0025 mol of ammonium chloride in 100 ml of heavy aromatic naphtha (HAN) either with the treatment compound of the invention or without (blank). After the reflux period, the sublimed ammonium chloride was washed from the internal surface of the condenser with water. The amount of ammonium chloride sublimed on these surfaces was then determined by the phenate method for the determination of nitrogen, as defined above.

The amount of sublimed ammonium chloride according to the aforementioned test procedure is shown in Table I, below.

TABLE I

Amount of Ammonium Chloride Sublimed Expressed as a Percentage of The Initial Ammonium Chloride

| Treatment | Treatment:Ammonium Chloride (mole:mole) | % Ammonium Chloride Sublimed |
|---|---|---|
| Blank (mean) | — | 61 +/− 10* |
| DMAPA | 0.8:1 | 2 |
| DETA | 1:1 | 3 |
| EDA | 0.9:1 | 6 |
| TREN | 1:1 | 1 |

*average of 10 runs.

The amount of ammonium chloride deposited on the internal surfaces of the reflux apparatus without treatment was approximately 61% of the total ammonium chloride added to the test apparatus prior to refluxing. The treatment with the non-filming polyamines reduced by approximately 97% the amount of ammonium chloride sublimed on overhead surfaces.

The foregoing example is intended as being indicative of the efficacy of the invention. In no way should it be construed as limiting the scope of the invention as disclosed herein.

What I claim is:

1. A method for inhibiting the deposition of ammonium chloride on the internal surfaces of refinery equipment which processes liquid hydrocarbon at elevated temperatures comprising adding to the liquid hydrocarbon an effective deposition inhibiting amount of a non-filming polyamine having the structure:

$R_2N—[(CHR')_xNH]_y—H$ where $R=H$ or $C_1$–$C_6$ alkyl or $—[(CHR')_xNH]_y—H$ $R'=H$ or $C_1$–$C_6$ alkyl or $—[(CHR')_xNH]_y—H$ $x=2, 3$ $y=1$–$6$.

2. The method of claim 1 wherein the non-filming polyamine is selected from the group consisting of dimethylaminopropylamine, diethylenetriamine, ethylenediamine and tris(2-aminoethyl) amine.

3. The method of claim 1 wherein the amount of non-filming polyamine added to the liquid hydrocarbon is based upon the amount of ammonium chloride present in the liquid hydrocarbon.

4. The method of claim 3 wherein ammonia is added to the liquid hydrocarbon for the purpose of neutralizing HCl present in the liquid hydrocarbon prior to the addition of the non-filming polyamine.

5. The method of claim 4 wherein from about 1 to 10 moles of non-filming polyamine is added to the liquid hydrocarbon per mole of ammonium chloride.

6. The method of claim 1 wherein elevated temperatures consists of 200° to 500° F.

7. A method for removing ammonium chloride deposits on the internal surfaces of refinery equipment which processes liquid hydrocarbon at elevated temperatures comprising adding to the liquid hydrocarbon an effective deposition removing amount of a non-filming polyamine having the structure:

$R_2N—[(CHR')_xNH]_y—H$ where $R=H$ or $C_1$–$C_6$ alkyl or $—[(CHR')_xNH]_y—H$ $R'=H$ or $C_1$–$C_6$ alkyl or $—[(CHR')_xNH]_y—H$ $x=2,3$ $y=1$–$6$.

8. The method of claim 7 wherein the non-filming polyamine is selected from the group consisting of dimethylaminopropylamine, diethylenetriamine, ethylenediamine and tris(2-aminoethyl)amine.

9. The method of claim 7 wherein the amount of non-filming polyamine added to the liquid hydrocarbon is based upon the amount of ammonium chloride present in the liquid hydrocarbon.

10. The method of claim 9 wherein ammonia is added to the liquid hydrocarbon for the purpose of neutralizing HCl present in the liquid hydrocarbon prior to the addition of the non-filming polyamine.

11. The method of claim 10 wherein from about 1 to 10 moles of non-filming polyamine is added to the liquid hydrocarbon per mole of ammonium chloride.

12. The method of claim 7 wherein elevated temperatures is in the range of 200° to 500° F.

* * * * *